US006123432A

United States Patent [19]

Feng

[11] Patent Number: 6,123,432

[45] Date of Patent: Sep. 26, 2000

[54] ADJUSTABLE MOUNTING ASSEMBLY FOR MOUNTING A FLUORESCENT LIGHTING DEVICE

[76] Inventor: Tao-Tang Feng, No. 100, Wen-Chang-I St., Pei Dist., Taichung City, Taiwan

[21] Appl. No.: 09/265,592

[22] Filed: Mar. 10, 1999

[51] Int. Cl.[7] ..... F21S 8/00

[52] U.S. Cl. ..... 362/147; 362/217; 362/221; 362/222; 362/260

[58] Field of Search ..... 362/147, 217, 362/220, 221, 222, 223, 260

[56] References Cited

U.S. PATENT DOCUMENTS 4,725,931 2/1988 Bourdon ..... 362/151

5,440,466 8/1995 Belisle et al. ..... 362/222

5,743,627 4/1998 Casteel ..... 362/222

*Primary Examiner*—Sandra O'Shea

*Assistant Examiner*—John Anthony Ward

*Attorney, Agent, or Firm*—Foley & Lardner

[57] ABSTRACT

An adjustable mounting assembly includes a lampshade member having a major wall that extend in a longitudinal direction and that forms a storing space in cooperation with a base plate disposed above the lampshade member and fixed on a wall structure. The major wall of the lampshade member defines a guiding slot therethrough in communication with the storing space such that two end seats for holding a fluorescent tube can be mounted on the major wall by inserting two fastener members through the end seats and the guiding slot for fastening on the base plate.

5 Claims, 5 Drawing Sheets

ADJUSTABLE MOUNTING ASSEMBLY FOR MOUNTING A FLUORESCENT LIGHTING DEVICE

FIELD OF THE INVENTION

The invention relates to a mounting assembly, more particularly to an adjustable mounting assembly for mounting a fluorescent lighting device on a wall structure.

BACKGROUND OF THE INVENTION

Referring to FIG. 1, a conventional mounting assembly for mounting a fluorescent lighting device is shown to include a pair of mounting posts 12 adapted to be fitted securely on a wall structure 16, and a lampshade member 12 connected to and disposed below the mounting posts 12 in order to receive a fluorescent tube 15 therein via left and right end seats 14 and an electronic ballast 13 which are also mounted on the lampshade member 11 to electrically connect the fluorescent tube 15 to a power source.

The aforesaid conventional mounting assembly can not be used to mount a fluorescent tube of variable length, because the length of the lampshade member is fixed.

SUMMARY OF THE INVENTION

Therefore, the object of this invention is to provide an adjustable mounting assembly for mounting a fluorescent lighting device on a wall structure and which has a lampshade member that can accommodate different lengths of fluorescent tubes.

Accordingly, the adjustable mounting assembly of this invention is adapted for mounting a fluorescent lighting device on a wall structure. The fluorescent lighting device includes an elongate fluorescent tube which has two end bases opposite to each other in a first longitudinal direction, and two electrodes disposed on the fluorescent tube. Each of the electrodes is proximate to and extends outwardly of a respective one of the end bases in the first longitudinal direction to form two mounting pins that are spaced apart from each other and that extend in the first longitudinal direction. Each of left and right end seats is disposed to be brought into electrical contact with the mounting pins, and includes an anchored mount, and a socket portion that extends from the anchored mount in a first transverse direction when a respective one of the end seats is brought into electrical contact with the mounting pins. Electrically conductive leads are disposed to electrically connect the left and right end seats to a power source. An electronic ballast is disposed to electrically connect with one of the left and right end seats. The adjustable mounting assembly includes an elongate base plate adapted to be secured to the wall structure, a storage space forming intermediate frame, a lampshade member, first and second retaining members, and first and second fastening members. The elongate base plate includes a first major wall that extends in a second longitudinal direction, and first front and rear edge portions at two sides of the first major wall and that extend in the second longitudinal direction. The storage space forming intermediate frame includes a second major wall elongated in the second longitudinal direction and disposed under and spaced apart from the first major wall in a second transverse direction which is transverse to the second longitudinal direction. The second major wall defines a plurality of mounting holes in the second transverse direction. The mounting holes are located in and are spaced apart from one another along a positioning line which is parallel to the second longitudinal direction. The second major wall has second front and rear edge portions at two sides thereof and that extend in the second longitudinal direction, and second front and rear side walls that extend downwardly from the second front and rear edge portions in the second transverse direction to terminate at second front and rear lateral edges. The second front and rear lateral edges are distal to the second front and rear edge portions, respectively. The lampshade member includes a third major wall disposed under and spaced from the second major wall in the second transverse direction and elongated in the second longitudinal direction so as to confine a storing space with the second major wall in order to be adapted to receive the electrically conductive leads in the storing space. The third major wall defines a guiding slot therethrough to be communicated with the storing space, and extends in the second longitudinal direction so as to align the guiding slot with the positioning line. The third major wall has third front and rear edge portions at two sides thereof. First front and rear retaining members are respectively disposed between and along the first and second front edge portions, and between and along the first and second rear edge portions so as to anchor the storage space forming intermediate frame on the elongate base plate when the storage space forming frame is brought towards the elongate base plate along either of the second longitudinal direction and the second transverse direction. Second front and rear retaining members are respectively disposed between and along the second front lateral edge and the third front edge portion, and between the second rear lateral edge and the third rear edge portion so as to anchor the lampshade member on the storage space forming intermediate frame when the lampshade member is brought towards the storage space forming intermediate frame along either of the second longitudinal direction and the second transverse direction. A plurality of first fastening members are disposed to pass through the guiding slot so as to be securely fitted in the mounting holes in order to be adapted to mount the left and right end seats on the third major wall such that the end seats are oriented in the first transverse direction. A second fastening member is disposed to pass through the guiding slot and is adapted to pass through the electronic ballast in order to adjustably position the electronic ballast on the third major wall along the positioning line.

BRIEF DESCRIPTION OF THE DRAWINGS

Other features and advantages of this invention will become more apparent in the following detailed description of the preferred embodiments of this invention, with reference to the accompanying drawings, in which.

DETAILED DESCRIPTION OF THE PREFERRED EMBODIMENTS

Figure 1:
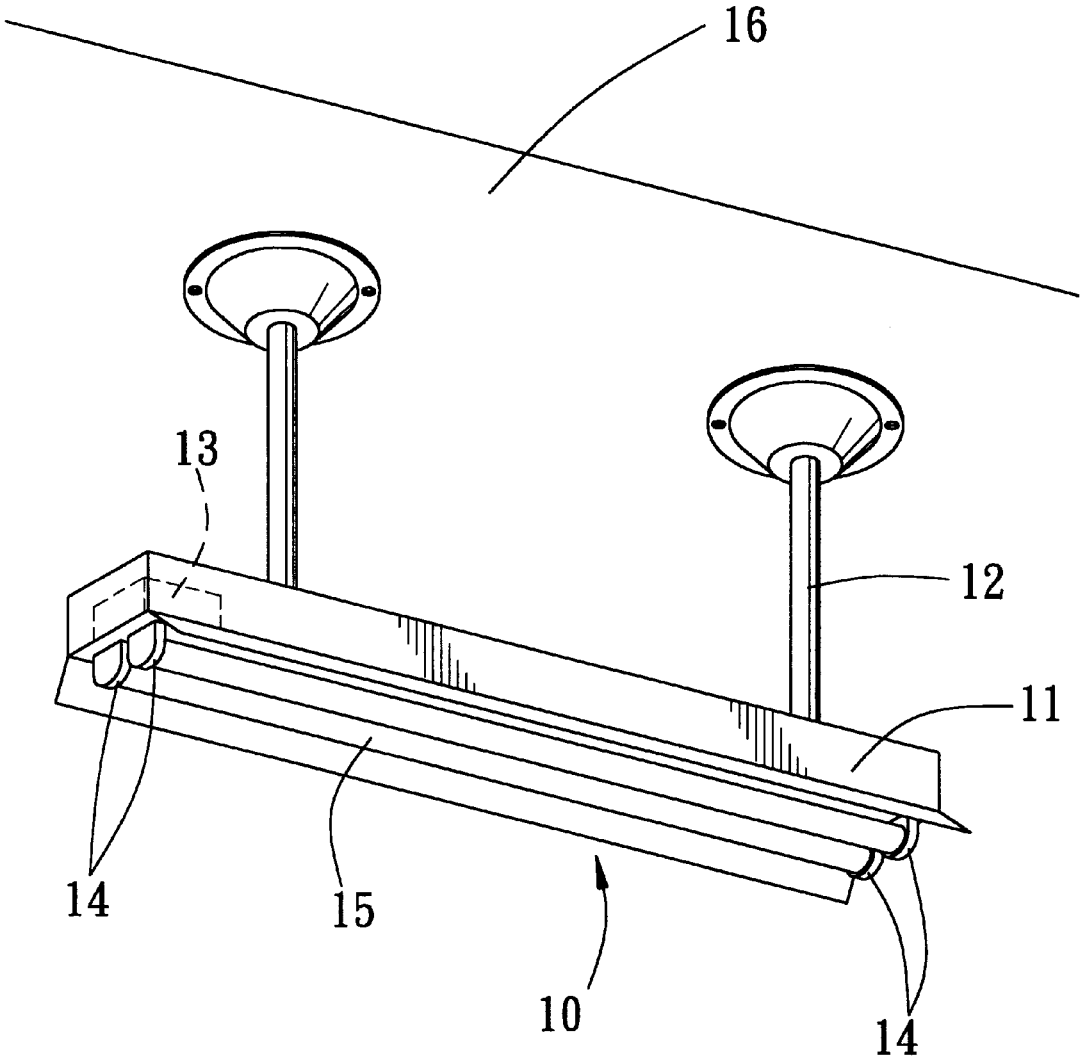
FIG. 1 PRIOR ART
FIG. 1 is a perspective view of a conventional mounting assembly by the use of which a fluorescent lighting device is mounted on a wall structure.
Figure 2:
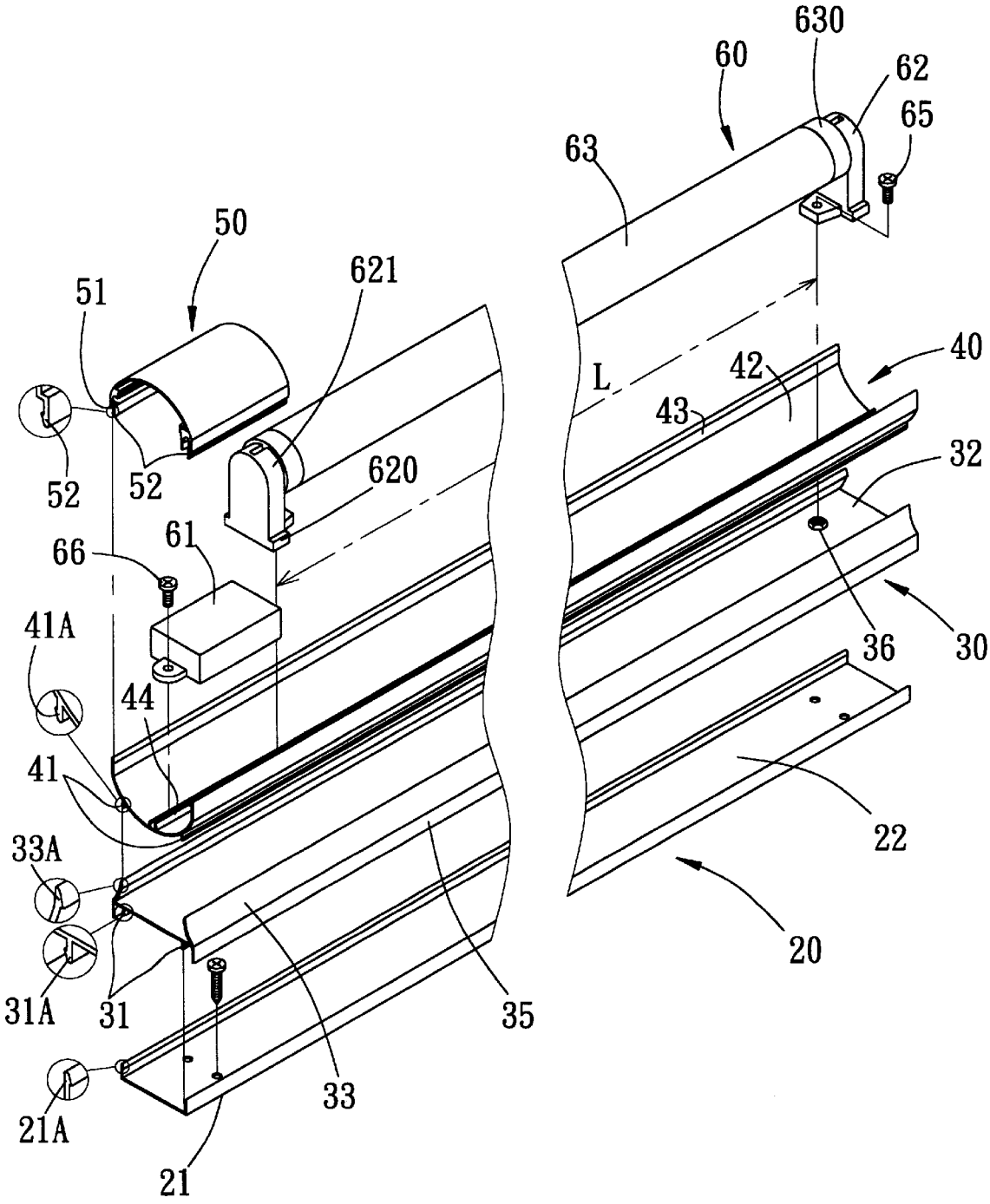
FIG. 2 is an exploded view of the preferred embodiment of an adjustable mounting assembly of this invention shown together with a fluorescent lighting device for mounting the latter on a wall structure.
Figure 3:
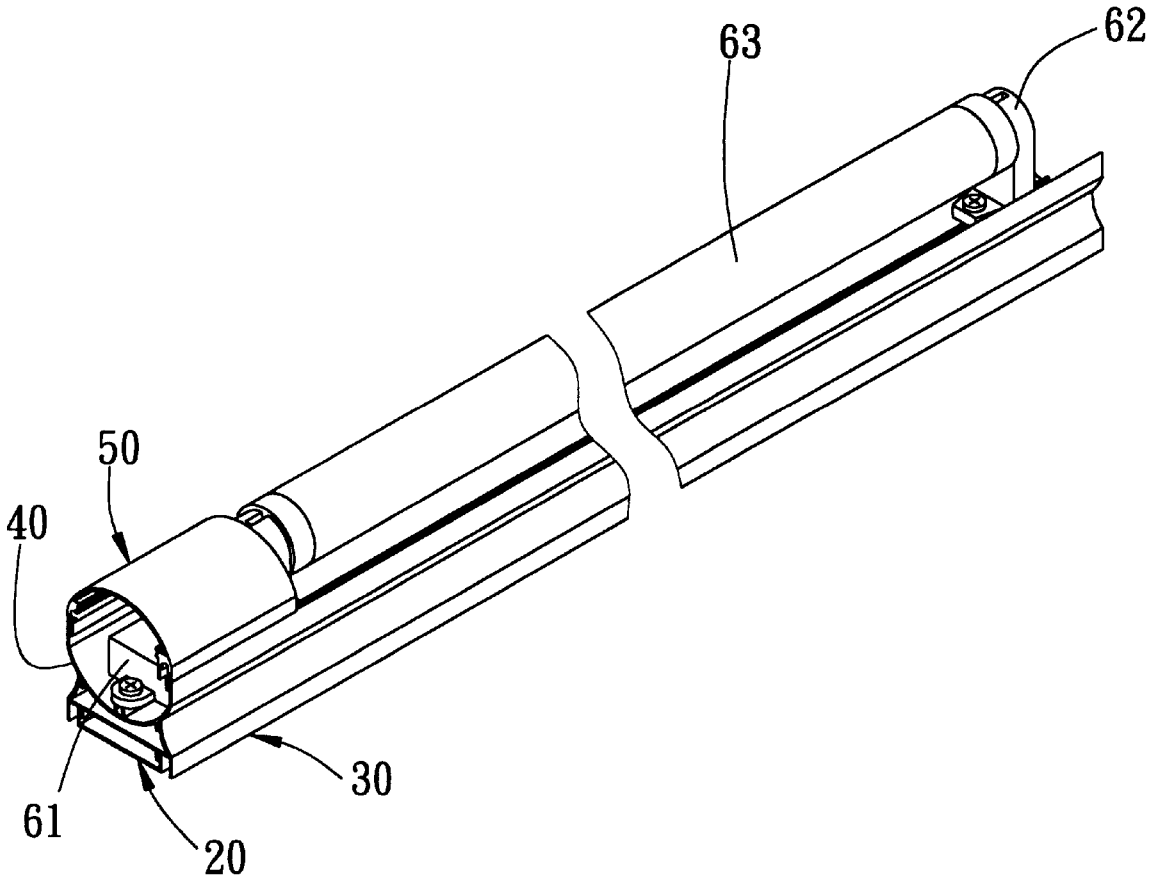
FIG. 3 is a perspective view of the preferred embodiment when provided with a fluorescent lighting device thereon.
Figure 4:
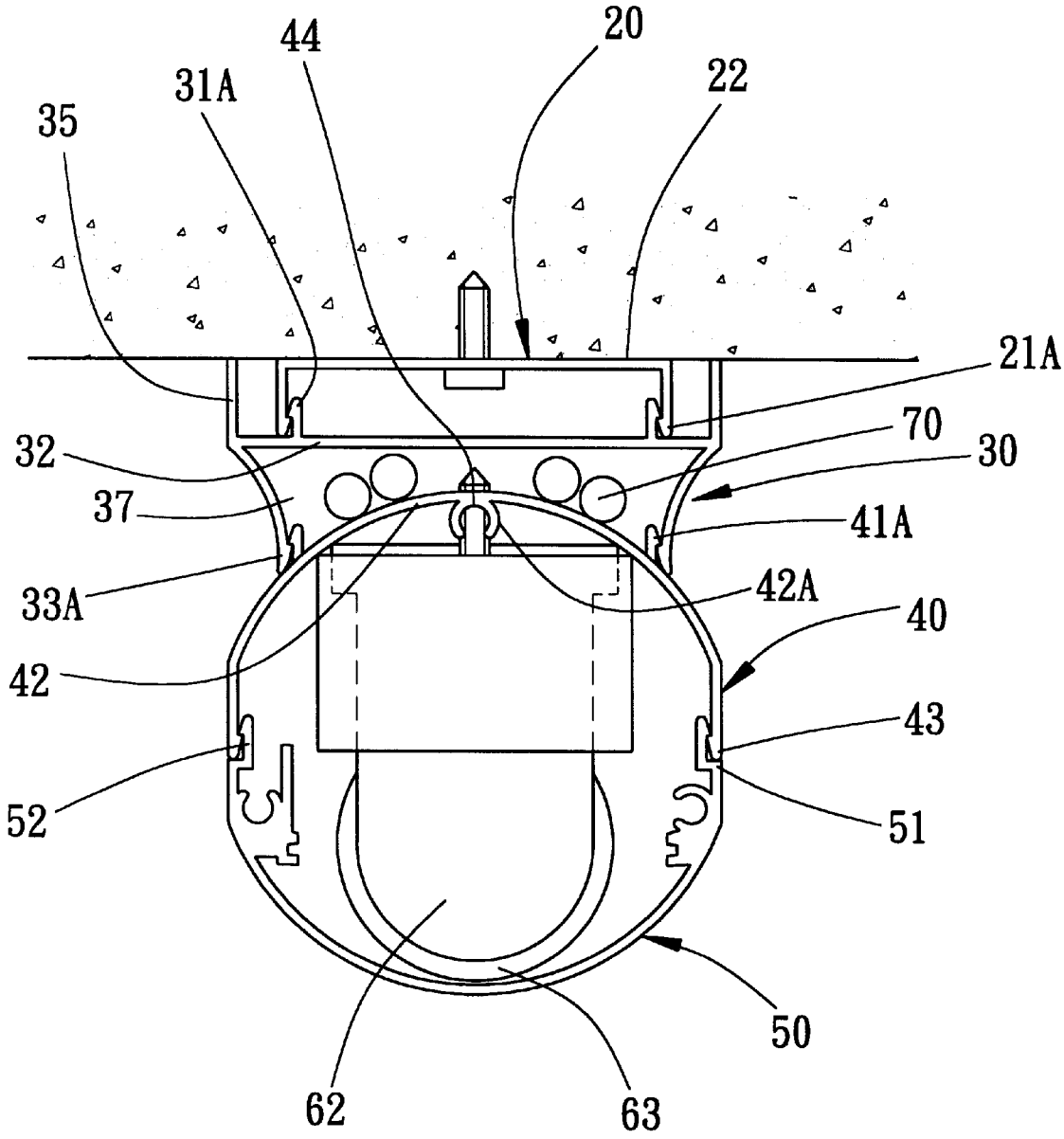
FIG. 4 is a side view of the preferred embodiment when mounted on the wall structure and holding a fluorescent lighting device thereon.

Referring to FIGS. 2, 3 and 4, the preferred embodiment of an adjustable mounting assembly of this invention is adapted for mounting a fluorescent lighting device 60 on a wall structure 70, and includes an elongate base plate 20, a storage space forming intermediate frame 30, a lampshade member 40, first and second retaining members, and first and second fastening members 65, 66.

As illustrated, the fluorescent lighting device 60 includes an elongate fluorescent tube 63 which has two end bases 630 opposite to each other in a first longitudinal direction, and two electrodes (not visible) disposed on the fluorescent tube 63. Each of the electrodes is proximate to and extends outwardly from a respective one of the end bases 630 in the first longitudinal direction to form two parallel mounting pins that extend in the first longitudinal direction.

Each of left and right end seats 62 is disposed to be brought into electrical contact with the mounting pins, and includes an anchored mount 620, and a socket portion 621 that extends from the anchored mount 620 in a first transverse direction.

A plurality of electrically conductive leads 70 are disposed to electrically connect the left and right end seats 62 to a power source.

An electronic ballast 61 is disposed to electrically connect in series with one of the left and right end seats 62.

The base plate 20 is adapted to be secured to the wall structure 70, and includes a first major wall 22 that extends in a second longitudinal direction, and first front and rear edge portions 21 at two sides of the first major wall 22 and that extend in the second longitudinal direction.

The storage space forming intermediate frame 30 includes a second major wall 32 elongated in the second longitudinal direction and disposed under and spaced apart from the first major wall 22 in a second transverse direction which is transverse to the second longitudinal direction. The second major wall 32 is formed with a plurality of mounting holes 36 (only one is shown in FIG. 2) which extend in the second transverse direction. The mounting holes 36 are located in and are spaced apart from one another along a positioning line (L) which is parallel to the second longitudinal direction. The second major wall 32 has second front and rear edge portions 31 at two sides thereof and that extend in the second longitudinal direction, and second front and rear side walls 33 that extend downwardly from the second front and rear edge portions 31 in the second transverse direction to terminate at second front and rear lateral edges 331 distal to the second front and rear edge portions 31, respectively.

The lampshade member 40 includes a third major wall 42 disposed under and spaced from the second major wall 32 in the second transverse direction. The third major wall 42 is of arch-shaped cross-section and is elongated in the second longitudinal direction so as to confine a storing space 37 with the second major wall 32 such that the conductive leads 70 can be received in the storing space 37. The third major wall 42 defines a guiding slot 44 therethrough to be communicated with the storing space 37. The slot 44 extends in the second longitudinal direction and is aligned with the positioning line (L). The third major wall 42 has third front and rear edge portions 41 at two sides thereof.

The first front and rear retaining members are respectively disposed between and along the first and second front edge portions 21, 31, and between and along the first and second rear edge portions 21, 31 so as to anchor the storage space forming intermediate frame 30 on the base plate 20 when the storage space forming frame 30 is brought towards the base plate 20 along either of the second longitudinal direction and the second transverse direction.

The second front and rear retaining members are respectively disposed between and along the second front lateral edge 31 and the third front edge portion 41, and between the second rear lateral edge 31 and the third rear edge portion 41 so as to anchor the lampshade member 40 on the storage space forming intermediate frame 40 when the lampshade member 40 is brought towards the storage space forming intermediate frame 30 along either of the second longitudinal direction and the second transverse direction.

Two first fastening members 65 pass through the guiding slot 44 of the third major wall 42 to be securely fitted in the mounting holes 36 in order to be adapted to mount the left and right end seats 62 on the third major wall 42 such that the end seats 62 are oriented in the first transverse direction.

The second fastening member 66 passes through the guiding slot 44 of the third major wall 42 and is adapted to pass through a through hole in the electronic ballast 61 in order to adjustably position the electronic ballast 61 on the third major wall 42 along the positioning line (L).

Note that the third major wall 42 has two opposing flanks 42A extending downwardly therefrom to confine the guiding slot 44. Each of the first and second retaining members includes a plurality of interlockable barbed ends 21A, 31A, 33A, 41A.

The preferred embodiment further includes a shielding cap 50 formed with barbed ends 52 at peripheral edges 51 thereof and adapted to be inserted in either of the second longitudinal and transverse directions to engage two downwardly extending barbed edges 43 of the lampshade member 40 in order to conceal the electronic ballast 61. The storage space forming intermediate frame 30 further includes two parallel decorating flanks 35 which are disposed on the second major wall 32 to extend in the second longitudinal direction and outboard to the second front and rear edge portions 31 so as to conceal the base plate 20 once the storage space forming intermediate frame 30 is mounted on the base plate 20.

In mass production, the elongate base plate 20, the storage space forming intermediate frame 30 and the lampshade member 40 are produced in a continuous form so that an appropriate length thereof can be cut to form a mounting assembly of a desired length. Different lengths of fluorescent tubes can be mounted on the adjustable mounting assembly according to this invention.

Figure 5:
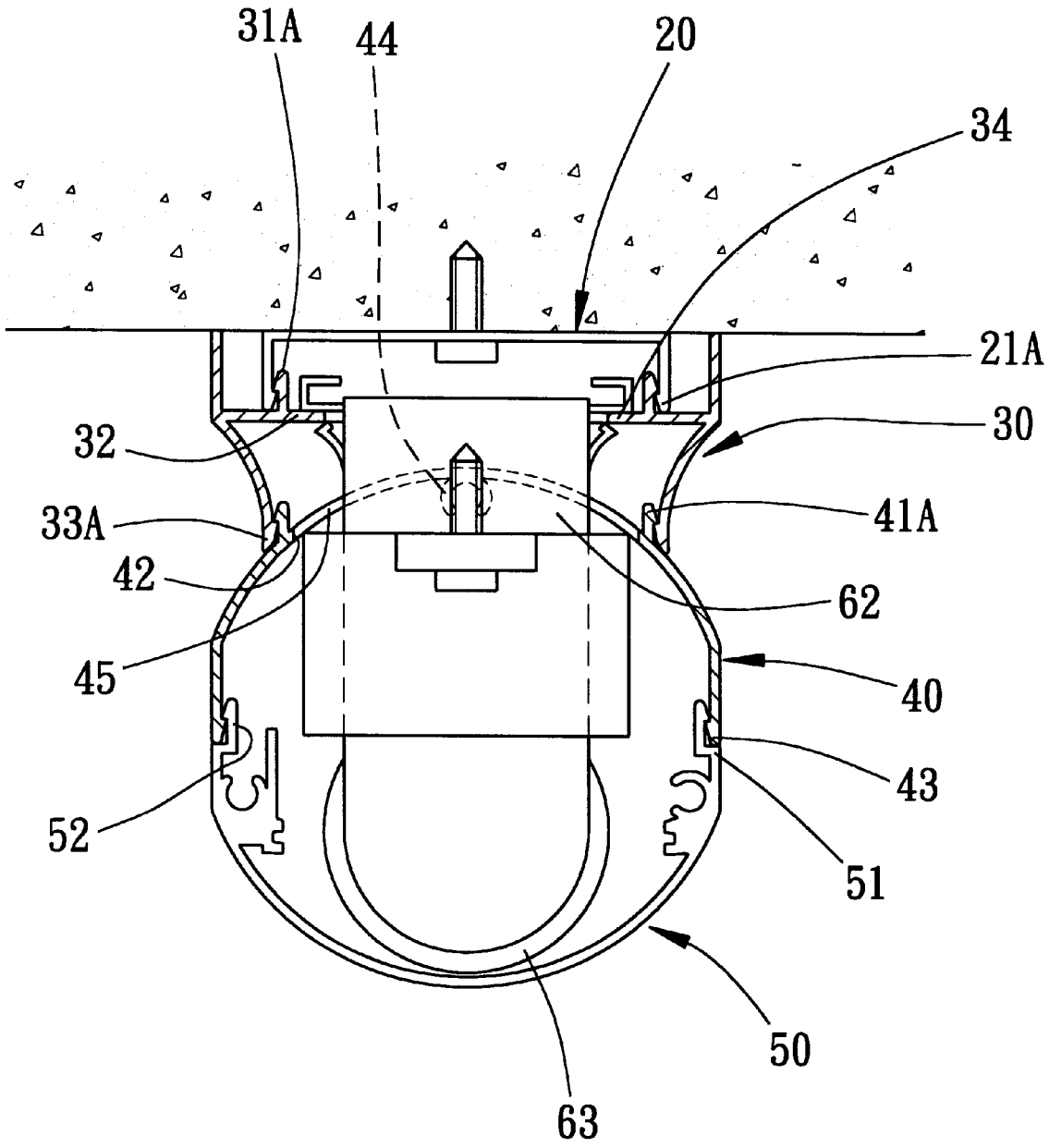
FIG. 5 is a side view of a modified embodiment of this invention when mounted on a wall structure and holding a fluorescent lighting device thereon.

FIG. 5 shows a modified preferred embodiment of this invention. The embodiment of FIG. 5 is similar to the previous embodiment in construction, except in that the second major wall 32 of the storage space forming intermediate frame 20 is formed with two mounting apertures 34 spaced apart from each other in the second longitudinal direction. The third major wall 42 of the lampshade member 40 is formed with two mounting apertures 45 transverse to the guiding slot 44 and aligned with the apertures 34 respectively such that during assembly of the mounting assembly, the anchored mount 620 of each of the end seats 62 can pass through a respective one of the apertures 45 so as to be retained in the aperture 34, after which the lampshade member 40 can be attached to the storage space forming intermediate frame 30 in the aforesaid manner so as to protrude the socket portion 621 (see FIG. 2) outwardly of the lampshade member 40. The object and feature are the same as those of the previous embodiment.

With this invention thus explained, it is apparent that numerous modifications and variations can be made without departing from the scope and spirit of this invention. It is therefore intended that this invention be limited only as indicated in the appended claims.

I claim:

1. An adjustable mounting assembly for mounting a fluorescent lighting device on a wall structure, the fluorescent lighting device including:

an elongate fluorescent tube having two end bases opposite to each other in a first longitudinal direction, and two electrodes disposed on the fluorescent tube, each of the electrodes being proximate to and extending outwardly of a respective one of the end bases in the first longitudinal direction to form two mounting pins that are spaced apart from each other and that extend in the first longitudinal direction;

left and right end seats, each disposed to be brought into electrical contact with the mounting pins and including an anchored mount, and a socket portion extending from the anchored mount (620) in a first transverse direction when a respective one of the end seats is brought into electrical contact with the mounting pins;

electrically conductive leads disposed to electrically connect the left and right end seats to a power source; and an electronic ballast disposed to connect electrically with one of the left and right end seats, the adjustable mounting assembly comprising:

an elongate base plate adapted to be secured to the wall structure, said base plate including a first major wall extending in a second longitudinal direction, and first front and rear edge portions at two sides of said first major wall and extending in said second longitudinal direction;

a storage space forming intermediate frame including a second major wall elongated in said second longitudinal direction and disposed under and spaced apart from said first major wall in a second transverse direction which is transverse to said second longitudinal direction, said second major wall defining a plurality of mounting holes therein which extend in said second transverse direction, said mounting holes being located in and being spaced apart from one another in a positioning line which is parallel to said second longitudinal direction, said second major wall having second front and rear edge portions at two sides thereof and each extending in said second longitudinal direction, and second front and rear side walls extending downwardly from said second front and rear edge portions and in said second transverse direction to terminate at second front and rear lateral edges distal to said second front and rear edge portions, respectively;

a lampshade member including a third major wall disposed under and spaced from said second major wall in said second transverse direction and elongated in said second longitudinal direction so as to confine a storing space with said second major wall in order to be adapted to receive the electrically conductive leads in said storing space, said third major wall defining a guiding slot therethrough to be communicated with said storing space and extending in said second longitudinal direction so as to align said guiding slot with said positioning line, and third front and rear edge portions at two sides of said third major wall;

first front and rear retaining members respectively disposed between and along said first and second front edge portions, and between and along said first and second rear edge portions so as to anchor said storage space forming intermediate frame on said elongate base plate when said storage space forming frame is brought towards said elongate base plate along either of said second longitudinal direction and said second transverse direction;

second front and rear retaining members respectively disposed between and along said second front lateral edge and said third front edge portion, and between said second rear lateral edge and said third rear edge portion so as to anchor said lampshade member on said storage space forming intermediate frame when said lampshade member is brought towards said storage space forming intermediate frame along either of said second longitudinal direction and said second transverse direction;

a plurality of first fastening members disposed to pass through said guiding slot to be securely fitted in said mounting holes in order to be adapted to mount the left and right end seats on said third major wall and with the left and right end seats oriented in the first transverse direction; and a second fastening member disposed to pass through said guiding slot and adapted to pass through the electronic ballast in order to adjustably position the electronic ballast on said third major wall along said positioning line.

2. The adjustable mounting assembly as defined in claim 1, wherein said third major wall has two opposing flanks extending downwardly therefrom to confine said guiding slot.

3. The adjustable mounting assembly as defined in claim 1, wherein each of said first and second retaining members includes a plurality of interlockable barbed ends.

4. The adjustable mounting assembly as defined in claim 1, further comprising a shielding cap adapted to be inserted in either of said second longitudinal and transverse directions to engage said lampshade member in order to conceal the electronic ballast.

5. The adjustable mounting assembly as defined in claim 1, wherein said storage space forming intermediate frame further includes two parallel decorating flanks which are disposed on said second major wall to extend in said second longitudinal direction and which are outboard to said second front and rear edge portions so as to conceal said elongate base plate once said storage space forming intermediate frame is mounted on said elongate base plate.

* * * * *